US007865979B2

(12) United States Patent
Hand

(10) Patent No.: US 7,865,979 B2
(45) Date of Patent: Jan. 11, 2011

(54) FLUSH VALVE STRUCTURE FOR A TOILET TANK

(76) Inventor: Douglas P. Hand, 17321 Canyon Dr., Lake Oswego, OR (US) 97034

( * ) Notice: Subject to any disclaimer, the term of this patent is extended or adjusted under 35 U.S.C. 154(b) by 0 days.

(21) Appl. No.: 12/577,505

(22) Filed: Oct. 12, 2009

(65) Prior Publication Data

US 2010/0024114 A1 Feb. 4, 2010

Related U.S. Application Data

(63) Continuation-in-part of application No. 11/775,433, filed on Jul. 10, 2007, now abandoned.

(51) Int. Cl.
*E03D 3/12* (2006.01)

(52) U.S. Cl. ..... 4/325; 4/391; 4/399; 4/403

(58) Field of Classification Search ..... 4/324, 4/325, 378, 383, 389–391, 395, 397, 399, 4/403, 404

See application file for complete search history.

(56) References Cited

U.S. PATENT DOCUMENTS 413,590 A * 10/1889 White ..... 4/391
1,069,658 A * 8/1913 Drew ..... 4/383
1,450,133 A * 3/1923 Cahill ..... 4/391
3,172,129 A * 3/1965 Fulton et al. ..... 4/390
4,604,763 A * 8/1986 Sprang ..... 4/391

* cited by examiner

*Primary Examiner*—Robert M Fetsuga
(74) *Attorney, Agent, or Firm*—Chernoff, Vilhauer, McClung & Stenzel

(57) ABSTRACT

A toilet tank flush valve structure includes a valve base for installation in the outlet hole formed in the floor of a toilet tank and defining a water outflow passage and including a first valve member at the upper end of the water outflow passage. A float assembly is movable relative to the valve base between a sealing position in which a second valve member at a lower end of the float assembly engages the first valve member in sealing relationship and a flushing position in which the second valve member is spaced upwardly from the first valve member. The float assembly includes an outer shell that is open downwards and has a lower edge at which the shell is provided with the second valve member, and a closure member within the outer shell and cooperating with the outer shell to define a float chamber. The closure member is adjustable in position relative to the outer shell, whereby the float chamber is adjustable in volume.

21 Claims, 8 Drawing Sheets

FLUSH VALVE STRUCTURE FOR A TOILET TANK

CROSS-REFERENCE TO RELATED APPLICATION

This application is filed as a continuation-in-part of copending patent application Ser. No. 11/775,433, the entire disclosure of which is hereby incorporated by reference herein for all purposes.

BACKGROUND OF THE INVENTION

The subject matter disclosed herein relates to a flush valve structure for a toilet tank.

FIG. 4 of copending U.S. patent application Ser. No. 11/775,433 discloses a single volume flush valve structure for a toilet tank. The single volume flush valve structure comprises a valve base that is secured in the outflow hole of the toilet tank. An extension flares upward from the valve base and a first part of a valve seal is attached to, or integrally formed with, the extension at the upper end thereof. A vertical guide is attached to the valve base and extends upward therefrom and a float assembly is fitted slidably over the guide. The float assembly includes a second, complementary, part of the valve seal, which engages the first part of the valve seal when the float assembly is in a lower position relative to the valve base. Because of the flared nature of the extension, the float assembly is typically of somewhat greater diameter than the outlet hole of the toilet tank. A pressure difference across the seal holds the two parts of the seal in sealing relationship. When the float assembly is lifted relative to the valve base, water passes between the two parts of the valve seal and relieves the pressure difference that would otherwise exist across the seal, allowing the float assembly to rise. Water then flows from the tank through the gap between the two parts of the valve. When the level of water in the tank falls approximately to the level of the first part of the seal, the two parts of the valve seal against each other and as water continues to enter the tank the pressure difference across the seal holds the two parts of the seal in position and the seal is thereby restored. U.S. patent application Ser. No. 11/777,433 does not disclose how the float assembly shown in FIG. 4 of that application may be modified to achieve a dual volume flush, or how to adjust the volume of water that is discharged during a single flush.

SUMMARY OF THE INVENTION

In accordance with a first aspect of the disclosed subject matter there is provided a toilet tank flush valve structure, for use with a toilet tank having a floor formed with an outlet hole, the flush valve structure comprising a valve base for installation in the outlet hole formed in the floor of the toilet tank, the valve base defining a water outflow passage having an upper end and a lower end and including a first valve member at the upper end of the water outflow passage, and a float assembly that is movable relative to the valve base between a sealing position in which a second valve member at a lower end of the float assembly engages the first valve member in sealing relationship and a flushing position in which the second valve member is spaced upwardly from the first valve member, and wherein the float assembly comprises an outer shell that is open downwards and has a lower edge at which the shell is provided with said second valve member, and a closure member within the outer shell and cooperating with the outer shell to define a float chamber, and wherein the closure member is adjustable in position relative to the outer shell, whereby the float chamber is adjustable in volume.

In accordance with a second aspect of the disclosed subject matter there is provided a toilet tank structure comprising a toilet tank having a floor formed with an outlet hole, a valve base installed in the outlet hole in the floor of the toilet tank, the floor of the toilet tank defining a water outflow passage having an upper end and a lower end, a first valve member at the upper end of the water outflow passage, and a float assembly that is movable relative to the valve base between a sealing position in which a second valve member at a lower end of the float assembly engages the first valve member of the valve base in sealing relationship and a flushing position in which the second valve member is spaced upwardly from the first valve member, and wherein the float assembly comprises an outer shell that is open downwards and has a lower edge at which the shell is provided with said second valve member, and a closure member within the outer shell and cooperating with the outer shell to define a float chamber, and wherein the closure member is adjustable in position relative to the outer shell, whereby the float chamber is adjustable in volume.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1A:
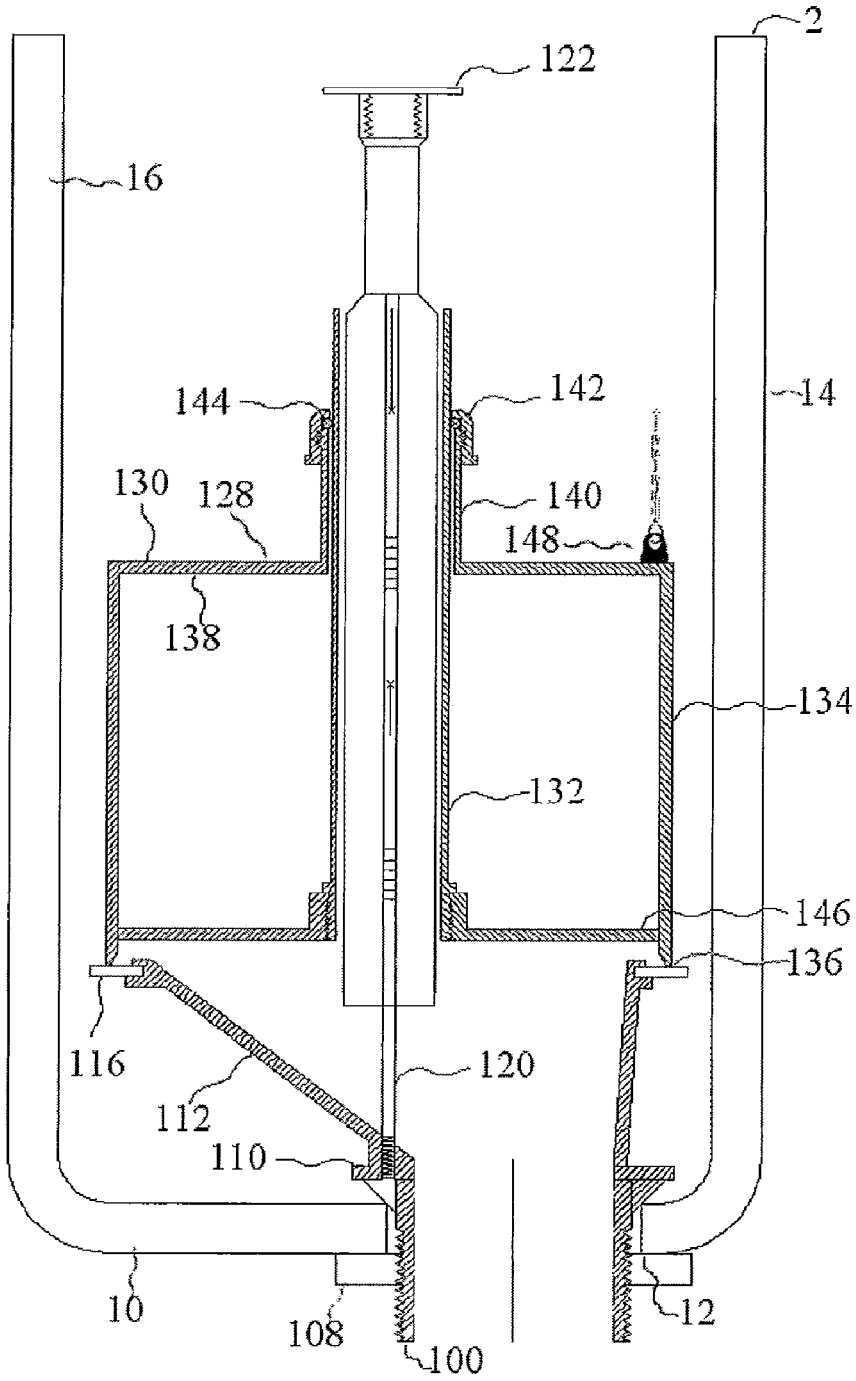
FIG. 1A is a sectional view of a conventional toilet tank equipped with a first flush valve structure in a first adjustment configuration.

The toilet tank 2 shown in FIG. 1A is a conventional low-volume toilet tank having a floor 10 formed with an outlet hole, or outflow passage, 12 and also having front and rear walls 14, 16 and two side walls (not shown). The front and rear walls are typically about 7 inches apart whereas the side walls may be about 14 inches apart. As shown in FIG. 1A, the hole may be substantially closer to the front wall 14 than the rear wall 16.

The flush valve structure that is shown in FIG. 1A comprises a valve base 100 that is installed in the hole 12 in the floor 10 of the toilet tank and is held in position by a nut 108 that is in threaded engagement with a water outflow tube of the base 100. The valve base 100 includes a flange 110, and an extension 112 extends upward from the flange. The extension 112 may be integrally formed with the valve base 100, e.g. by concurrent injection molding of the base and the extension, or may be formed as a separate component that is attached to the valve base. The extension defines a passage that is circular in horizontal section at all points over its height, but the horizontal cross-sectional area of the passage is substantially greater at the top of the extension than the bottom. For example, the diameter of the passage at the bottom of the extension may be less than 2 inches, in order to match a valve base sized to fit in a standard 2 inch outlet hole, whereas the diameter of the passage at the top of the extension may be almost 5 inches. Thus, as shown in FIG. 1A, the extension 112 flares upward from the flange 110. Moreover, the extension has a skewed configuration, in that the locus of the center of the circular horizontal cross section of the passage is inclined to vertical, so that the center of the circular cross section of the passage at the top of the extension is located approximately midway between the front and rear walls of the tank even though the center of the outlet hole is closer to the front wall than the rear wall. A sealing member, or first valve member, 116 is attached to the extension 112 at the top. In this case, the sealing member 116 is a flexible gasket.

A guide 120 extends vertically upward from the valve base. The lower end of the guide 120 is a relatively slender rod that is in threaded engagement with the flange 110 of the base. Above its lower end, the guide has a cross-like configuration. At its upper end, the guide is provided with a removable stop member 122.

The flush valve structure shown in FIG. 1A also includes a float assembly 128. The float assembly 128 comprises an overflow tube 132 through which the guide 120 extends with a clearance that is sufficient to permit movement of the float assembly lengthwise of the guide without binding yet is small enough to ensure that the float assembly remains properly aligned relative to the sealing member 116. The float assembly and the base cooperate to form a column valve.

The float assembly further comprises an outer shell, or float body, 130 that is attached to the overflow tube. The outer shell has a cylindrical outer wall 134 provided at its lower end with a sealing member, or second valve member, 136 that cooperates with the sealing member 116 of the extension 112, a first annular disc-wall 138 extending inward from the outer wall 134 at the upper end thereof, and an inner boss 140 that extends upwardly from the first annular disc-wall 138 and through which the overflow tube 132 extends with a small clearance. The inner boss 140 is threaded at its upper end and lock nut 142 having an internal flange is in threaded engagement with the threads of the inner boss. When the lock nut 142 is tightened onto the inner boss 140, an O-ring 144 is clamped between the internal flange of the lock nut and the upper end of the boss. By clamping the O-ring in this manner, the O-ring grips the overflow tube, thus holding the outer shell in position relative to the overflow tube, and seals the clearance between the inner boss and the overflow tube. The inner periphery of the outer shell is thereby sealed relative to the overflow tube.

Figure 1B:
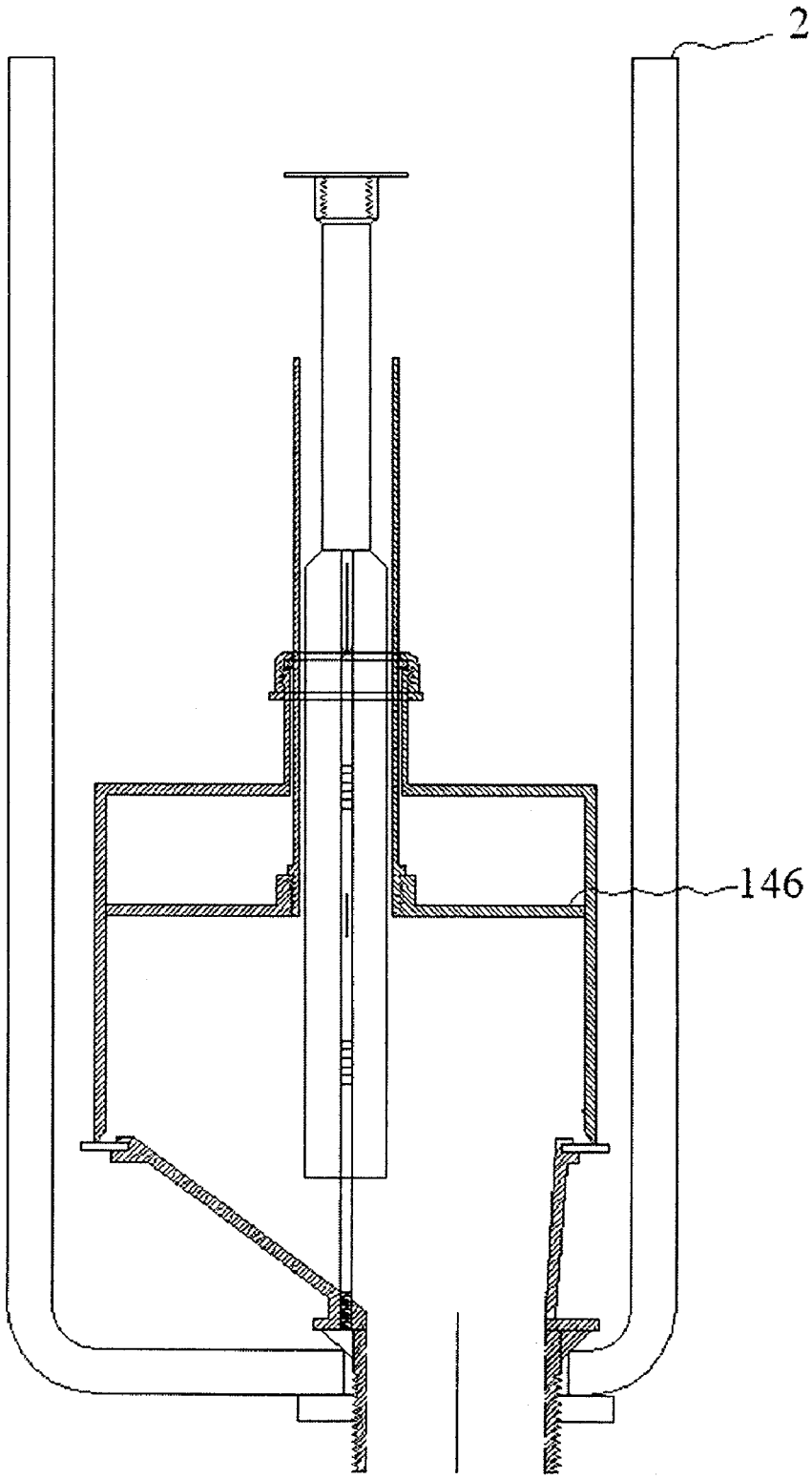
FIG. 1B is a view similar to FIG. 1A illustrating the flush valve structure in a second adjustment configuration.

A second or lower annular disc-wall, or closure member, 146 is attached to the lower end of the overflow tube, e.g. by screw threads, and a narrow clearance is provided between the outer periphery of the second annular disc-wall 146 and the interior surface of the outer cylindrical wall 134, allowing vertical movement of the second annular disc-wall 146 relative to the cylindrical outer wall 134. The outer shell 130, the overflow tube 132 and the second annular disc-wall 146 together define a float chamber. By releasing the lock nut 142, moving the outer shell 130 lengthwise of the overflow tube 132, and re-tightening the locknut, the position of the second annular disc-wall 146 relative to the first annular wall 138, and hence the volume of the float chamber, is adjustable. FIG. 1A shows the float assembly with the second annular disc-wall 146 positioned to maximize the volume and resultant buoyancy of the float chamber, whereas FIG. 1B shows the float assembly with the wall 146 positioned to provide a float chamber of substantially smaller volume and resultant lesser buoyancy.

Because the O-ring not only grips the overflow tube but also seals the float chamber at the upper end, air cannot be displaced from the float chamber by water entering the chamber through the clearance between the lower annular disc-wall 146 and the cylindrical outer wall 134. Otherwise, water entering the float chamber through the clearance could lead eventually to the float chamber becoming waterlogged. It may nevertheless be desirable to provide drain holes in the lower annular disc-wall to ensure that any water that enters the float chamber is able to drain from the float chamber.

The float assembly 128 is provided with an attachment ring 148 that can be connected to a flush lever (not shown) for lifting the float assembly from the seal.

When the flush lever is pressed sufficiently to lift the float assembly, the seal between the sealing members 116 and 136 is broken. Because of the large volume of the float chamber, the buoyancy of the float assembly overcomes the force due to the pressure of water on the top of the annular wall and any downward force acting on the float assembly due to flow of water into the passage defined by the extension. Accordingly, even though the user may immediately release pressure on the flush lever, the float assembly immediately rises until the upper end of the overflow tube 132 engages the stop member 122. When the upper end of the overflow tube engages the stop member, the float assembly initially remains in this position as the water level in the toilet tank falls due to outflow of water through the valve base, while water flow continues into the tank under control of the conventional fill valve. After this initial phase, the float assembly falls as the water level in the tank continues to fall until the float assembly is close enough to the sealing member 116 for the force acting on the float assembly due to flow of water into the outflow passage to overcome the buoyancy of the float assembly and pull the sealing member 136 into contact with the sealing member 116. The water level in the tank then rises, as is conventional, until the fill valve shuts off supply of water.

When the toilet bowl contains only liquid waste, the user activates the flush valve by pressing and immediately releasing the flush lever. Depending on the adjustment position of the second annular disc-wall 146 (as discussed below), the quantity of water that is discharged from the tank in response to a press and immediate release activation of the flush lever is sufficient to remove liquid waste and most solid waste from the toilet bowl. In the event that the user observes that solid waste remains in the bowl after pressing the flush lever, the user may maintain pressure on the flush lever, in which event the float assembly will remain elevated relative to the seal member at the upper rim of the extension and water will continue to flow through the valve and into the toilet bowl. The user releases the flush lever upon observing that the waste has been removed from the toilet bowl.

Figure 1C:
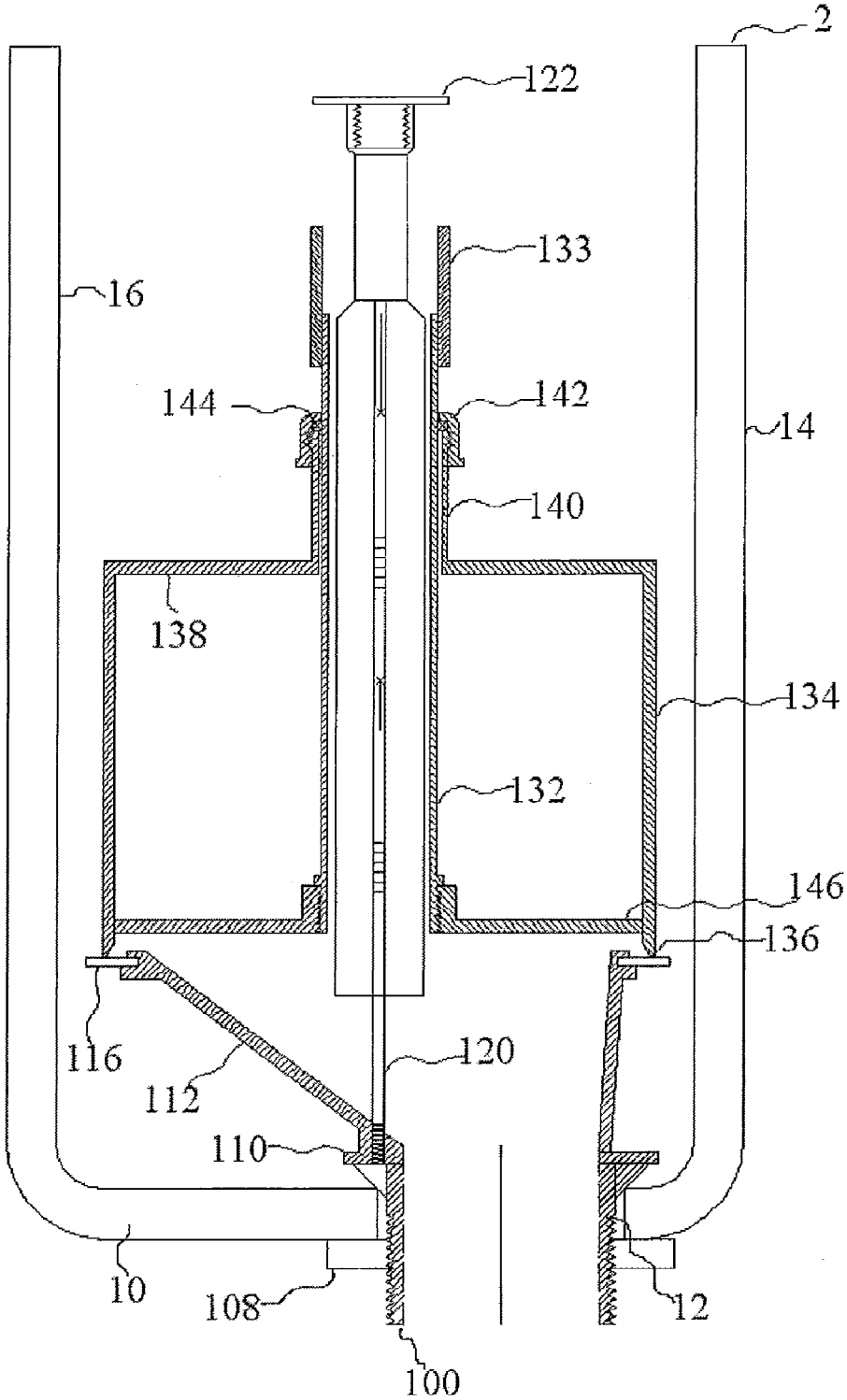
FIGS. 1C and 1D are views similar to FIG. 1A illustrating further modifications of the first flush valve structure.

The quantity of water discharged from the toilet tank in response to a press and immediate release activation of the flush lever depends on the extent of the upward travel of the float assembly from the lower position, in which the sealing member 136 in contact with the sealing member 116, to the upper position, in which further upward movement is limited by the stop member 122. The greater the distance, the longer is the time between breaking of the seal and restoration of the seal, and the greater is the quantity of water discharged. In the case of FIG. 1A, the extent of the upward travel of the float assembly 128 is equal to the distance between the top of the overflow tube 132 and the stop member 122 when the float assembly is in its lower position. In order to limit upward travel of the float assembly, and avoid waste of water, an overflow tube extension piece 133 may be attached to the overflow tube 132, as shown in FIG. 1C. The overflow tube extension piece 133 may be attached to the overflow tube 132 by, for example, use of screw threads, a taper fit, a ridge and groove snap lock, a worm drive hose clamp, or other means. The overflow tube extension piece 133 reduces the upward travel of the float assembly in response to a press and immediate release activation of the flush lever and thereby reduces the quantity of water discharged from the toilet tank.

Figure 1D:
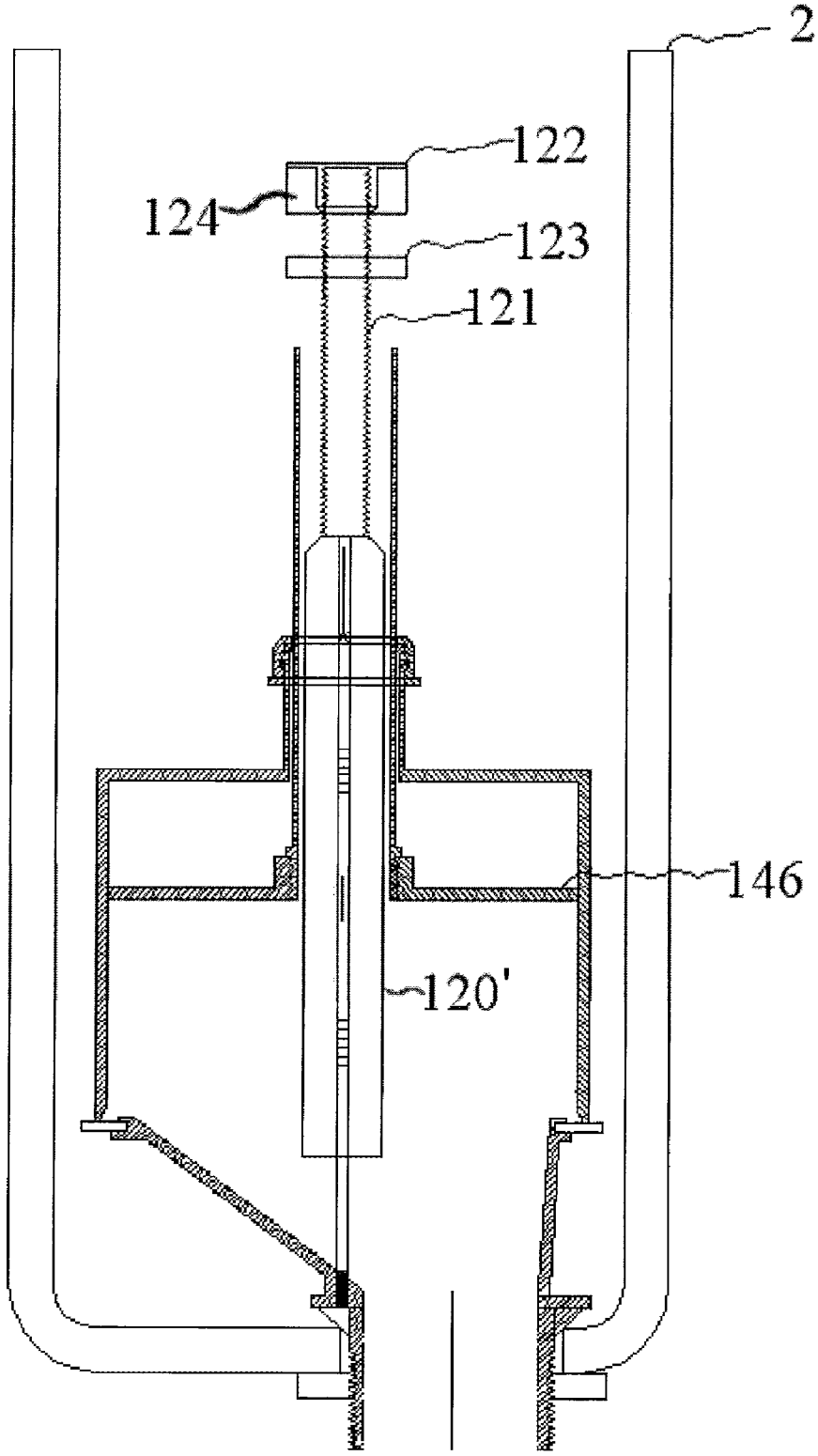

FIG. 1D illustrates further mechanisms for selectively limiting the extent of upward travel of the float assembly 128 in response to a press and immediate release activation of the flush lever. FIG. 1D shows that the upper end region 121 of the guide 120', above the section having a cross-like configuration, is threaded over its entire length. A nut 123 is in threaded engagement with the upper end region 121 and can be positioned at any desired height above the upper end of the overflow tube 132. Similarly to the overflow tube extension piece 133 shown in FIG. 1C, the nut 123 reduces the upward travel of the float assembly in response to a press and immediate release activation of the flush lever and thereby reduces the quantity of water discharged from the toilet tank. Alternatively, as also shown in FIG. 1D, the stop member 122, which is the same as that shown in FIG. 1A and is in threaded engagement with the upper end of the guide 120', may be provided with a collar or sleeve 124 that is attached to the stop member. When the flush valve is activated by pressing the flush lever, and the seal between the upper and lower seal members is broken, the float assembly immediately rises and the upper end of the float assembly engages the collar 124, which is used instead of the nut 123. In this case, the upward travel of the float assembly depends on the axial length of the collar 124.

Different models of toilet assemblies (toilet bowl and toilet tank) have different flushing characteristics. The different flushing characteristics of different models of toilet assemblies result in a greater or lesser quantity of water being needed to both remove liquid waste from the toilet bowl and restore its trapway water level. It has been found that by adjusting the height of the lower annular disc-wall relative to the upper annular disc it is possible to adjust the quantity of water that is discharged from the toilet tank in response to a press and immediate release activation of the flush lever. In particular, as the distance between the lower annular disc-wall and upper annular wall decreases, and correspondingly the height of the upper end of the overflow tube when the float assembly is in its sealing position, increases, the volume of water discharged from the toilet tank in response to a press and immediate release activation decreases. Accordingly, adjustability of the outer shell relative to the overflow tube, and corresponding adjustability of the volume of the float chamber, allows a given model of flush valve structure to be used with multiple models of toilet assemblies, each of which may require its own unique combination of flush volumes for satisfactory liquid and solid waste removal. This is useful because it allows a single model of flush valve structure to be used as a replacement part in multiple models of toilet assemblies.

Figure 2:
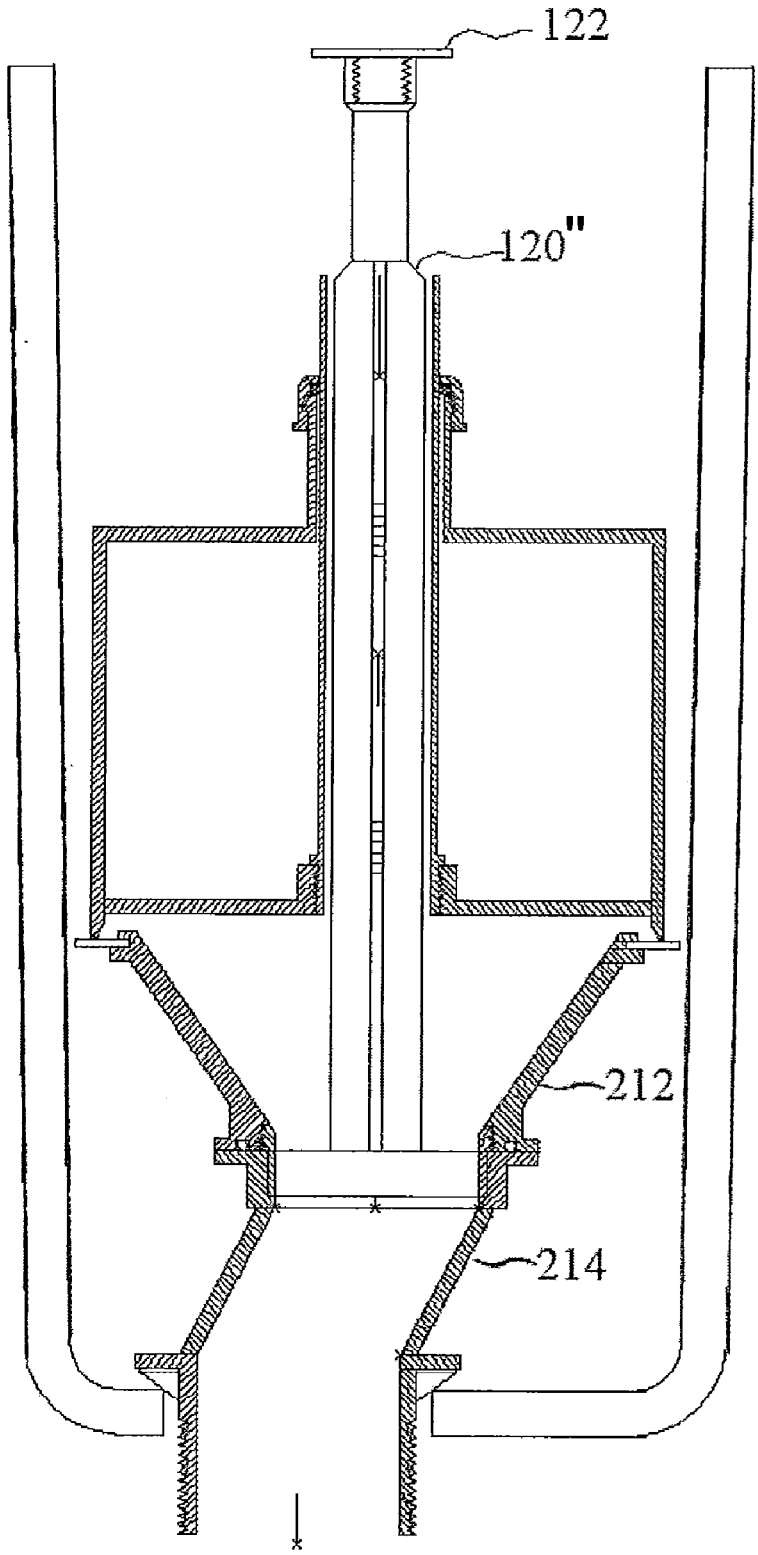
FIG. 2 is a sectional view of a conventional toilet tank equipped with a second flush valve structure.

In the case of the flush valve structure shown in FIGS. 1A and 1B, the central axis of the float assembly is offset horizontally from the central axis of the flange of the valve base by virtue of the skewed configuration of the flared extension 112. FIG. 2 illustrates a modification in which the flared extension 212 is not skewed but the central axis of the float assembly is nevertheless offset from the central axis of the flange of the valve base by virtue of a skewed lower extension 214. Thus, in the case of FIG. 2 the extension comprises a lower, skewed portion and an upper, flared portion. The guide 120" extends upward from the upper end of the lower extension 214. The structure of the float is the same in the case of FIG. 2 as in FIG. 1A.

Figure 3:
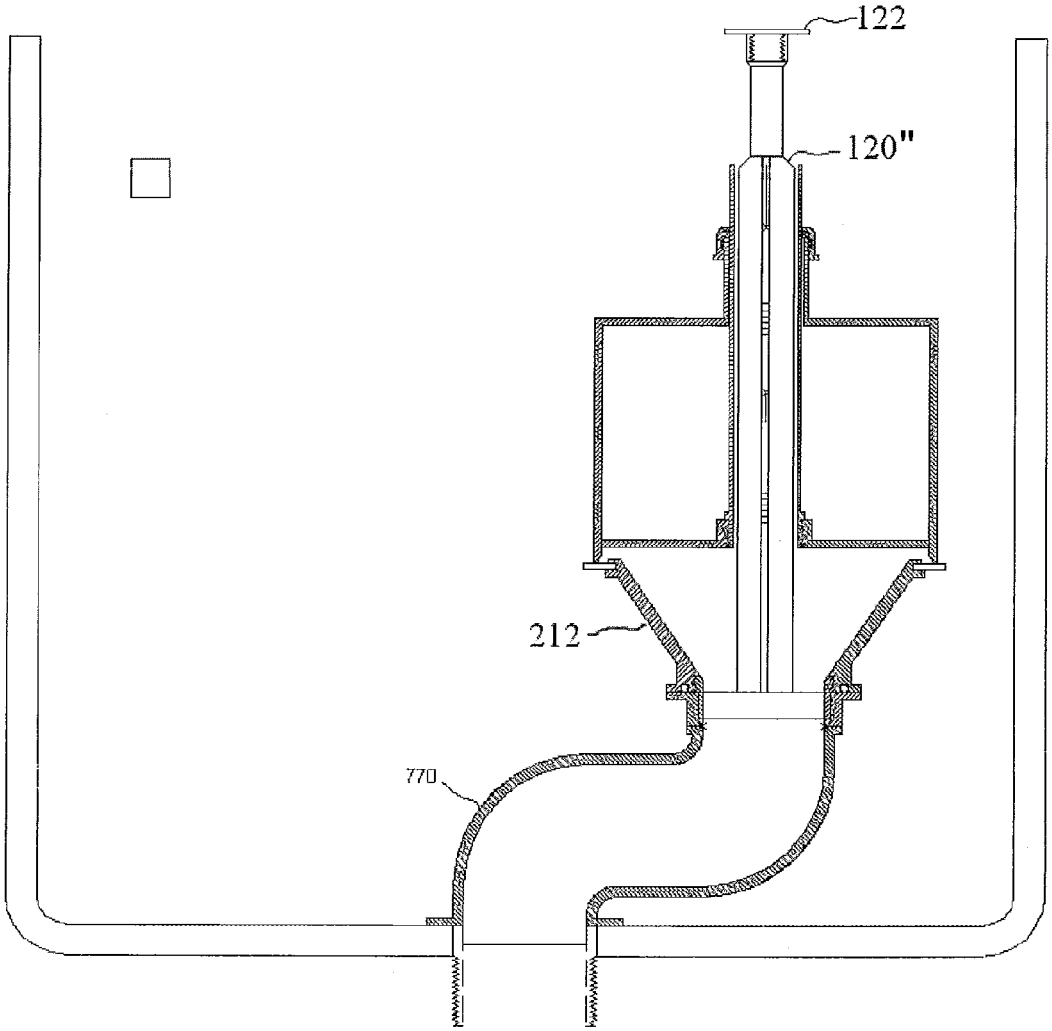
FIG. 3 is a sectional view of a toilet tank equipped with a third valve structure.

FIG. 3 illustrates a further modification of the flush valve structure shown in FIG. 1A. As shown in FIG. 3, the extension of the valve base comprises a lower portion in the form of an S-shaped tube 770 and a flared upper portion 212. The S-shaped tube allows the flush valve to be positioned near one of the side walls of the toilet tank.

Figure 4:
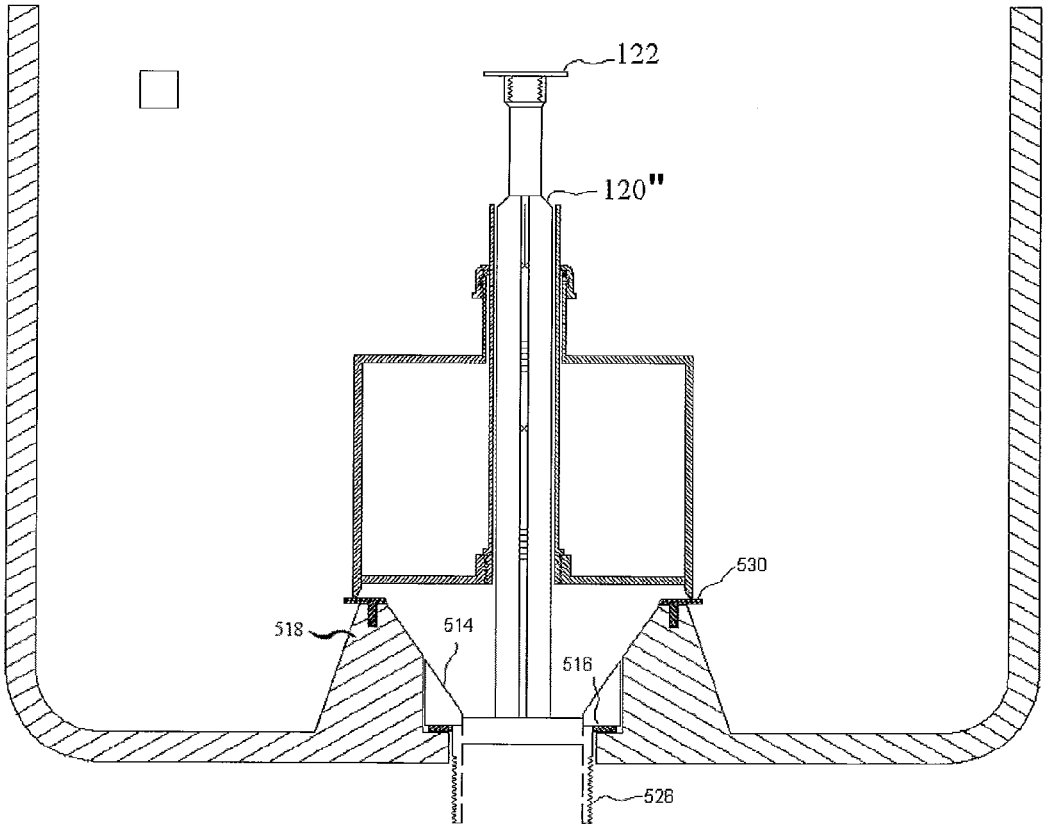
FIG. 4 is a sectional view of a toilet tank equipped with a fourth valve structure.

FIG. 4 illustrates a further modification of the flush valve structure. In this case, a valve base 514 provided with a seal 516 is fitted in a circular recess in the floor of the tank and the circular recess is surrounded by an annular plateau 518. The seat 530 is provided at the top of the annular plateau, which has a frusto-conical interior surface tapering downward towards the entry to the outflow tube 526. In the case of FIG. 4, therefore, the flared extension is built into the toilet tank.

Figure 5:
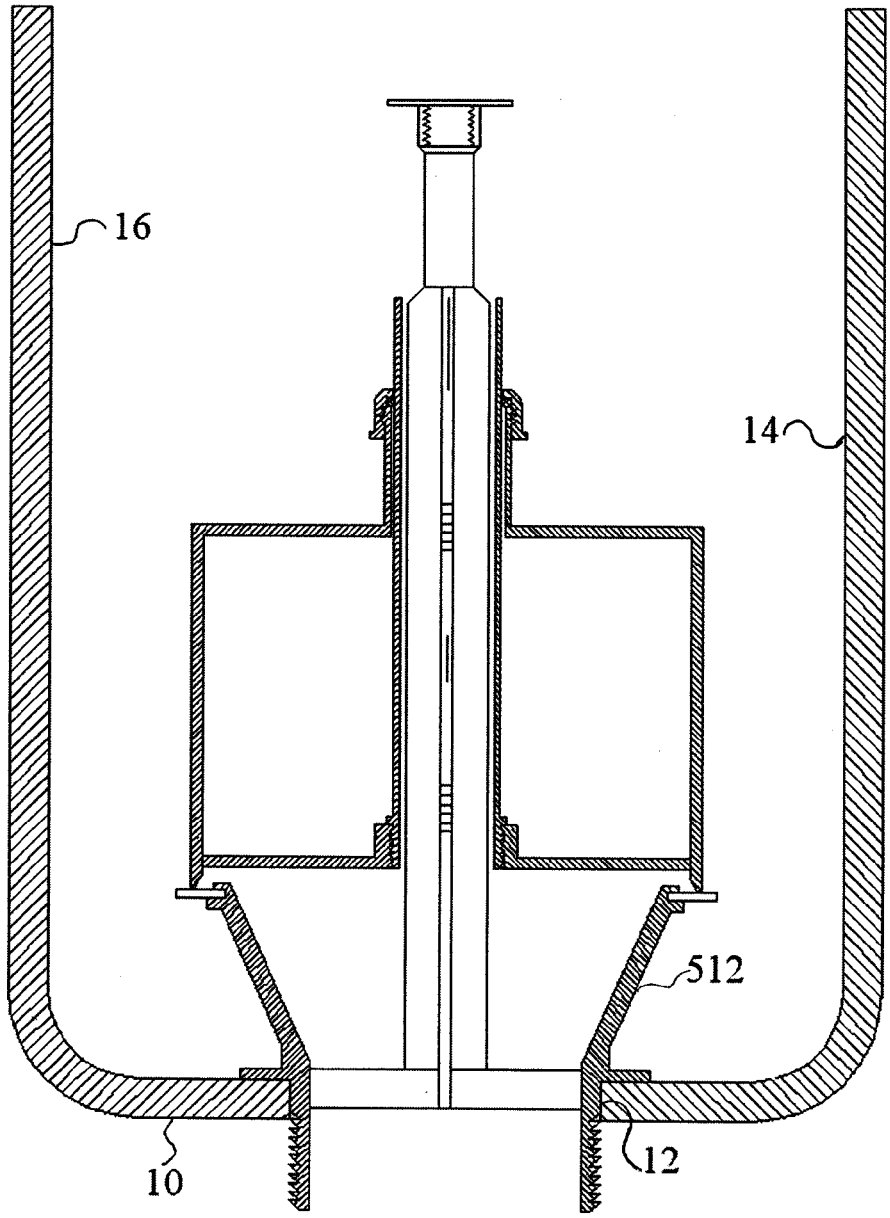
FIG. 5 is a sectional view of a toilet tank equipped with a fifth valve structure.

FIG. 5 illustrates a further modification of the flush valve structure shown in FIG. 1A. The outlet hole 12 of the toilet tank is centered between the front and rear walls 14, 16 of the toilet tank and accordingly it is not necessary that the extension 512 be skewed. Thus, the circular openings at the top and bottom respectively of the extension 512 are coaxial. In addition, the outlet hole 12 is of greater diameter than the outlet hole in the case of FIG. 1A. For example, in the case of FIG. 5 the outlet hole may be 3.5 inches in diameter.

In each of the illustrated embodiments of the claimed subject matter, the float assembly has a substantially greater cross-sectional area than the water outflow passage defined by the valve base. By employing a float assembly with a large cross-sectional area, the buoyancy of the float assembly is sufficient to ensure that immediately upon breaking the seal between the valve members, the float assembly will rise to the extent permitted by the stop member 122.

As noted previously, the stop member 122 is removable from the guide. This allows the height of the stop member to be adjusted by attaching the stop member to the guide using one or more adapters, for example as disclosed in U.S. Pat. No. 6,637,042. Adjusting the height of the stop member is an alternative means for adjusting the upward travel of the float assembly when the seal between the valve members is broken. Another means of adjusting the upward travel of the float assembly when the seal between the valve members is broken may employ interchangeable overflow tubes of different lengths, or an adjustable mechanism similar to the lock nut 142 may be used for attaching the second annular disc-wall 146 to the overflow tube 132, such that the overflow tube is adjustable in vertical position relative to the disc-wall 146. Another possibility would be to provide a single overflow tube with multiple circumferential lines of weakness spaced apart therealong over an upper end region so that, if needed, one or more short segments of the overflow tube may be easily broken off to provide a shorter tube, having a longer upward travel.

It will be appreciated that the invention is not restricted to the particular embodiment or embodiments that has or have been described, and that variations may be made therein without departing from the scope of the invention as defined in the appended claims, as interpreted in accordance with principles of prevailing law, including the doctrine of equivalents or any other principle that enlarges the enforceable scope of the claims beyond the literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

The invention claimed is:

1. A toilet tank flush valve structure, for use with a toilet tank having a floor formed with an outlet hole, the flush valve structure comprising:

a valve base for installation in the outlet hole formed in the floor of the toilet tank, the valve base defining a water outflow passage having an upper end and a lower end and including a first valve member at the upper end of the water outflow passage, and a float assembly that is movable relative to the valve base between a sealing position in which a second valve member at a lower end of the float assembly engages the first valve member in sealing relationship and a flushing position in which the second valve member is spaced upwardly from the first valve member, and wherein the float assembly comprises an outer shell that is open downwards and has a lower edge at which the shell is provided with said second valve member, and a closure member within the outer shell and cooperating with the outer shell to define a float chamber, and wherein the closure member is adjustable in position relative to the outer shell, whereby the float chamber is adjustable in volume.

2. A flush valve structure according to claim 1, wherein the valve base includes a flange for engaging the floor of the toilet tank, a water outflow tube that extends downward from the flange, and an extension that flares upwardly from the flange and is provided with the first valve member at an upper end of the extension.

3. A flush valve structure according to claim 2, wherein the water outflow passage decreases smoothly in cross-sectional area from the upper end of the extension to a lower end thereof.

4. A flush valve structure according to claim 2, wherein the extension is horizontally skewed, whereby the upper end of the extension is horizontally offset from a lower end thereof.

5. A flush valve structure according to claim 2, wherein the valve base includes an offset structure for positioning the upper end of the water outflow passage horizontally offset from the outlet hole formed in the floor of the toilet tank.

6. A flush valve structure according to claim 5, wherein the offset structure is an S-shaped tube.

7. A flush valve structure according to claim 5, wherein the offset structure is a skewed extension that flares upwardly.

8. A flush valve according to claim 2, wherein the valve base includes a horizontally skewed tube segment between the flange and the extension.

9. A flush valve according to claim 2, wherein the extension defines a circular opening at an upper end of the extension and a circular opening at a lower end of the extension, and the two circular openings are coaxial.

10. A flush valve structure according to claim 1, wherein the float assembly includes an overflow tube and the flush valve structure further includes a guide that extends upwards from the valve base through the overflow tube for guiding movement of the float assembly relative to the valve base.

11. A flush valve structure according to claim 10, wherein the closure member is attached to the overflow tube at a lower end thereof, the outer shell includes a cylindrical outer wall and an upper annular wall, and the upper annular wall of the outer shell has an inner periphery that is in sealing relationship with the overflow tube.

12. A flush valve structure according to claim 11, wherein the outer shell includes a cylindrical boss that extends upward from the inner periphery of the upper annular wall, and a clamping means for securing the cylindrical boss to the overflow tube at an upper end of the cylindrical boss, and wherein the clamping means effects a seal between the overflow tube and the cylindrical boss.

13. A flush valve structure according to claim 10, comprising a stop member attached to the guide at an upper end thereof, whereby upward travel of the float assembly from its sealing position is limited by engagement of the overflow tube with the stop member.

14. A flush valve structure according to claim 13, wherein a volume of water discharged from the tank depends on said upward travel, and said upward travel is selectively adjustable by an overflow tube extension piece secured adjustably to the overflow tube at an upper end thereof.

15. A flush valve structure according to claim 1, wherein the float assembly includes a float body and an overflow tube that extends through the float body and is slidingly adjustable relative to the float body, and the flush valve structure further includes a guide that extends upwards from the valve base through the overflow tube for guiding movement of the float assembly relative to the valve base.

16. A flush valve structure according to claim 15, comprising a stop means attached to the guide at an upper end thereof for limiting upward travel of the float assembly from its sealing position is limited by engagement with the stop means, and a means for selectively adjusting the extent of upward travel of the float assembly from its sealing position to a position in which the float assembly engages the stop means.

17. A flush valve structure according to claim 1, wherein the area of the water outflow passage decreases smoothly from the upper end to the lower end.

18. A flush valve structure according to claim 1, wherein the flush valve structure comprises a column valve that moves relative to the base by vertical displacement.

19. A flush valve structure according to claim 1, wherein the float assembly includes an overflow tube, the flush valve structure includes a guide that extends upwards from the valve base through the overflow tube for guiding movement of the float assembly relative to the valve base, the guide is provided at an upper end thereof with a stop means, and the closure member is attached to the overflow tube at a lower end thereof, whereby adjustment of the position of the closure member relative to the outer shell effects adjustment of the overflow tube relative to the stop means.

20. A toilet tank structure comprising:

a toilet tank having a floor formed with an outlet hole, a valve base installed in the outlet hole in the floor of the toilet tank, the floor of the toilet tank defining a water outflow passage having an upper end and a lower end, a first valve member at the upper end of the water outflow passage, and a float assembly that is movable relative to the valve base between a sealing position in which a second valve member at a lower end of the float assembly engages the first valve member of the valve base in sealing relationship and a flushing position in which the second valve member is spaced upwardly from the first valve member, and wherein the float assembly comprises an outer shell that is open downwards and has a lower edge at which the shell is provided with said second valve member, and a closure member within the outer shell and cooperating with the outer shell to define a float chamber, and wherein the closure member is adjustable in position relative to the outer shell, whereby the float chamber is adjustable in volume.

21. A toilet tank structure according to claim 20, wherein the floor of the toilet tank includes an annular plateau member that surrounds the outlet hole in the floor of the toilet tank, the annular plateau member has an inner surface that defines said water outflow passage, and the first valve member is attached to the annular plateau member at an upper end thereof.

* * * * *